US007228710B2

(12) United States Patent
Lifson

(10) Patent No.: US 7,228,710 B2
(45) Date of Patent: Jun. 12, 2007

(54) INDENTATION TO OPTIMIZE VAPOR INJECTION THROUGH PORTS EXTENDING THROUGH SCROLL WRAP

(75) Inventor: Alexander Lifson, Manlius, NY (US)

(73) Assignee: Scroll Technologies, Arkadelphia, AK (US)

( * ) Notice: Subject to any disclaimer, the term of this patent is extended or adjusted under 35 U.S.C. 154(b) by 192 days.

(21) Appl. No.: 11/140,699

(22) Filed: May 31, 2005

(65) Prior Publication Data

US 2006/0266076 A1 Nov. 30, 2006

(51) Int. Cl.
*F25B 41/00* (2006.01)

(52) U.S. Cl. ..... 62/513; 418/55.1; 418/55.2

(58) Field of Classification Search ..... 62/113, 62/115, 197, 513; 418/55.1; 218/55.2; 417/213, 417/299, 310, 423.14
See application file for complete search history.

(56) References Cited

U.S. PATENT DOCUMENTS 4,259,043 A * 3/1981 Hidden et al. ..... 418/55.3
4,439,118 A * 3/1984 Iimori ..... 418/55.5
4,453,899 A * 6/1984 Hiraga et al. ..... 418/55.4
4,475,360 A * 10/1984 Suefuji et al. ..... 62/324.1
4,690,625 A * 9/1987 Murayama et al. ..... 418/55.2
5,127,809 A * 7/1992 Amata et al. ..... 418/55.2
5,395,224 A * 3/1995 Caillat et al. ..... 418/55.6
6,089,839 A 7/2000 Bush
6,202,438 B1 * 3/2001 Barito ..... 62/513
6,350,111 B1 * 2/2002 Perevozchikov et al. ... 417/440
6,430,959 B1 8/2002 Lifson
6,474,087 B1 11/2002 Lifson
6,478,557 B2 * 11/2002 Shiibayashi et al. ..... 418/55.2
6,494,695 B1 * 12/2002 Lifson ..... 418/55.2
7,100,386 B2 * 9/2006 Lifson ..... 62/196.1
2004/0184932 A1 * 9/2004 Lifson ..... 417/310

FOREIGN PATENT DOCUMENTS

JP 11-230065 A * 8/1999

* cited by examiner

*Primary Examiner*—Mohammad M. Ali
(74) *Attorney, Agent, or Firm*—Carlson, Gaskey & Olds

(57) ABSTRACT

A scroll compressor is provided with economizer injection ports, which extend through the wrap of one of the scroll members. Preferably the injection ports are formed through a so-called "hybrid" wrap, which has a varying thickness. The other scroll member is provided with grooves in its base plate. The injection of economizer fluid occurs only during a portion of the orbiting cycle when the injection port and corresponding grooves are aligned with each other. An indentation is formed into the wrap that includes the injection port. The indentation is spaced circumferentially from the injection port. The indentation communicates with the groove, such that refrigerant can pass from the injection port, into the groove, and through the indentation into a compression chamber. This increases the injection time allowing more fluid to be injected into the compression chamber, and provides the scroll compressor designer with greater freedom to achieve desired flow of economizer fluid into the compression chambers.

14 Claims, 3 Drawing Sheets

INDENTATION TO OPTIMIZE VAPOR INJECTION THROUGH PORTS EXTENDING THROUGH SCROLL WRAP

BACKGROUND OF THE INVENTION

This application relates to placing economizer injection ports through the wrap of one of the scroll members in a scroll compressor and providing an indentation to enhance injection and improve unloading operation.

Scroll compressors are becoming widely utilized in refrigerant compression applications. As known, a pair of scroll members each has a base with a generally spiral wrap extending from the base. Typically, one scroll is non-orbiting and the other scroll orbits relative to the non-orbiting scroll. The orbiting scroll contacts the non-orbiting scroll to seal and define compression chambers. The compression chambers are moved toward a central discharge port as the orbiting scroll orbits relative to non-orbiting scroll. Originally scroll compressors tended to have relatively thin wraps. More recently, so called "hybrid" wraps have been developed wherein the thickness of the wrap varies along its length.

Refrigerant systems are also making increasing use of an economizer cycle in which an additional heat exchange process occurs and a portion of the refrigerant is directed back to the intermediate compression point within the compressor. At this intermediate point in the compression cycle, this refrigerant is injected into the compressor compression chambers through an economizer line and then into the compressor internal injection ports. This has the effect of increasing both system capacity and efficiency. The scroll compressor designer seeks to optimize the size and location of the internal injection ports to maximize the efficiency and capacity benefits as mentioned above.

The economizer ports were originally formed through the base of the non-orbiting scroll penetrating into the compression chambers. Typically, the injection occurred through the economizer injection ports at a point in the compression cycle when the refrigerant is sealed off from suction to define a first compression chamber. After the seal off point, the injection ports continue to communicate with the compression chambers for a significant period of the cycle, while at the same time the pressure within the compression chamber while initially relatively low continues to increase. This increase in pressure inside compression chambers results in refrigerant being pumped back into the economizer line. This produces so called pumping losses, and hence decreased compressor efficiency which is undesirable.

An improved scroll compressor is disclosed in U.S. Pat. No. 6,430,959. In this compressor, economizer fluid is injected into the compression chambers through ports formed within the wrap of the non-orbiting scroll. The wrap is of a "hybrid" profile such that it has varying thicknesses along its length.

The orbiting scroll member has small grooves formed in the floor of its base plate. When the ports are aligned with these grooves, economizer flow is injected into the compression chamber. However, once the orbiting scroll has moved such that the port is no longer aligned with the groove, the facing base plate of the orbiting scroll closes the port off. In this way, the scroll compressor designer is able to easily control the "on/off" time for the economizer injection into the compression chamber.

However, with this configuration a situation may arise that either the size of a port is not large enough or the port is not open for a sufficient time to inject a sufficient amount of vapor into the compression pocket. In particular this situation, would occur more often with regard to a port located at a thicker portion of the wrap.

Thus, while the above-described scroll compressor has proven quite successful, it would be desirable to further enhance the injection of the fluid through at least one of the two injection ports.

SUMMARY OF THE INVENTION

In a disclosed embodiment of this invention, there are at least two injection ports for delivering economizer fluid into two separate compression chambers. At least one economizer injection port extends through the wrap and selectively communicates with at least one groove in the base of an opposed scroll member. The wrap is further provided with at least one indentation, which enhances the flow of the economizer fluid into the compression chambers. As an example, if a port is located at a particularly thick portion of the scroll wrap, the wrap could completely cover the groove for a substantial period of time of the orbiting cycle. Thus, it might be difficult to inject a desired amount of economizer fluid. The use of the indentation increases the time when the compression chamber communicates with the injection port via the groove, providing the scroll compressor designer with additional freedom to design the most appropriate injection timing.

These and other features of the present invention can be best understood from the following specification and drawings, the following of which is a brief description.

DETAILED DESCRIPTION OF THE PREFERRED EMBODIMENT

Figure 1:
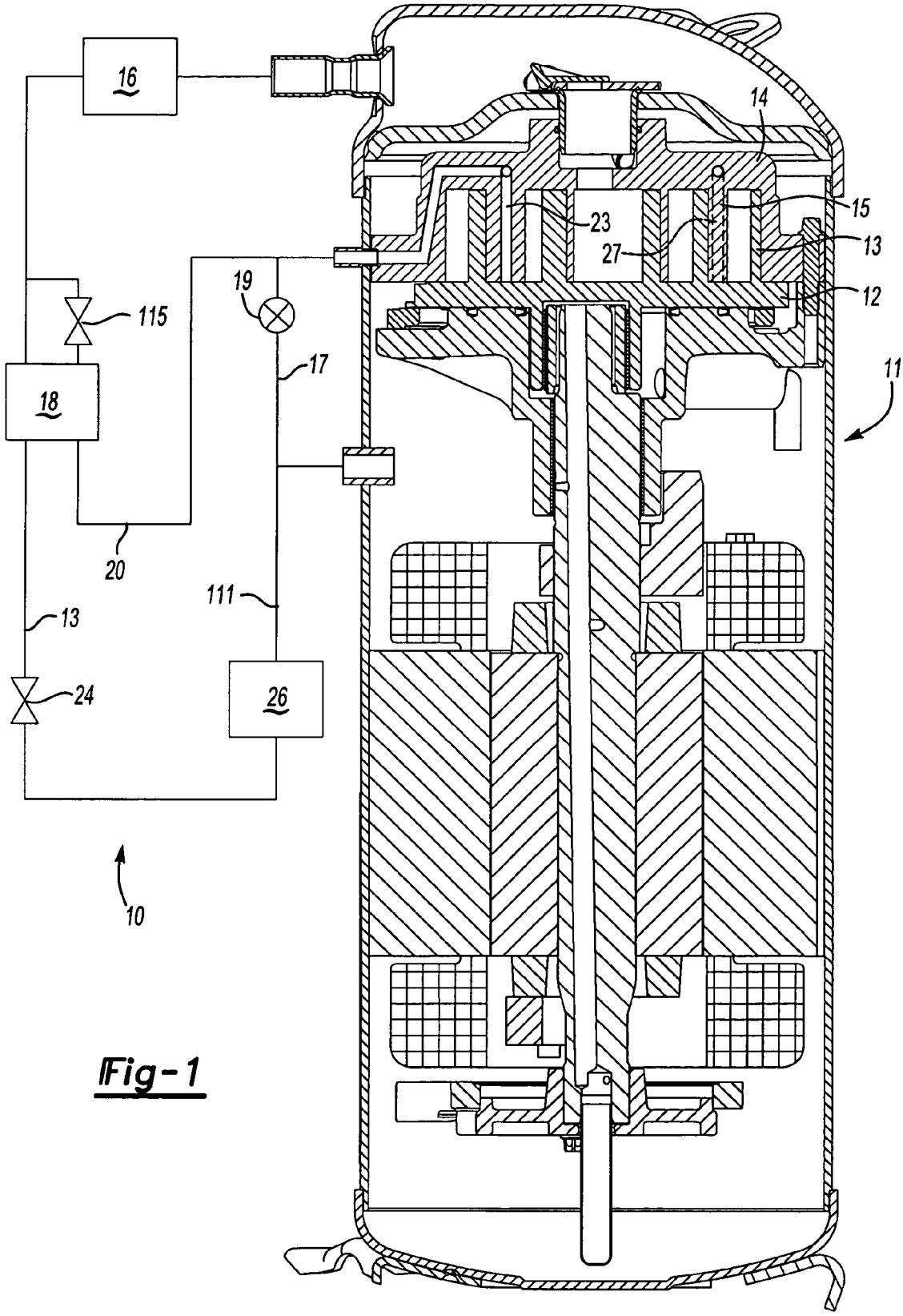
FIG. 1 is a schematic view of a refrigerant cycle incorporating a scroll compressor and an economizer cycle.

A refrigerant system 10 is illustrated in FIG. 1 having a compressor 11, an evaporator 26, a main expansion device 24, and a condenser 16. As is shown, an economizer heat exchanger 18 communicates through an economizer injection line 20 back to the compressor.

As shown, the compressor 11 is a scroll compressor having an orbiting scroll member 12 with a generally spiral wrap 13 and a non-orbiting scroll 14 with a spiral wrap 15. As is well known, these wraps interfit to define compression chambers. As shown, as an example, the economizer injection line 20 passes back into the compressor housing 11, and back through the wrap 15 of the non-orbiting scroll. The structure is generally disclosed in the above-referenced United States patent.

As shown, a line 20 passes through an economizer expansion device 115, and then through the economizer heat exchanger 18. As is known, by bypassing a tapped fluid through the expansion device 15 and the heat exchanger 18, a refrigerant in a main flow line 13 is subcooled in the economizer heat exchanger. The return or intermediate injection line 20 is shown returning the tapped refrigerant back to the compressor, as known.

As further known, an optional unloader or bypass line 17 selectively communicates the intermediate injection line 20 back to a suction line 111. When the valve 19 is opened, refrigerant can pass from ports (described below) in the scroll members, and back outwardly of the line 20, into the unloader line 17, through the valve 19, and back to the suction line 111. Again, this structure is as known.

Figure 2A:
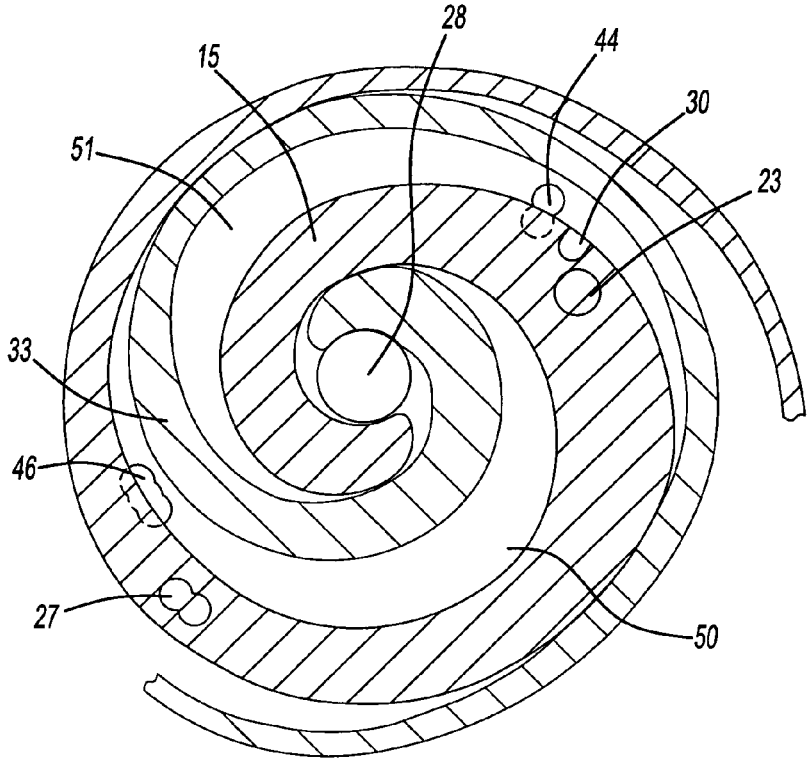
FIG. 2A shows the interfitting scroll members.

As shown in FIG. 2A, a non-orbiting scroll 14 which is part of the compressor of FIG. 1 includes wrap 15, which is preferably "hybrid" and as shown has a varying thickness along its circumferential extent.

Injection ports 23 and 27 are formed through the wrap 15. The injection ports may have a varying size. Further, the injection ports are preferably formed at a part of the wrap 15, which is not of its minimum thickness. The thicker wrap portion provides additional thickness such that an injection port of sufficient size can be formed through the wrap. As shown the discharge port 28, is formed through the rear face 31, as known.

Figure 2B:
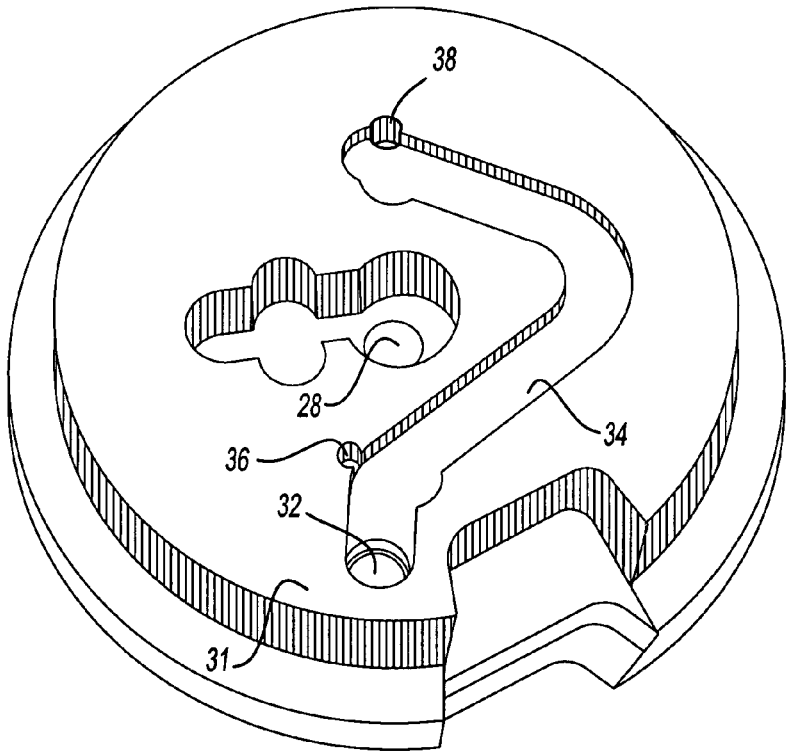
FIG. 2B is a view of the rear face of the non-orbiting scroll.

For the case when only one indentation is added on one portion of the wrap, as shown, an indentation 30 is formed spaced from the injection port 23. The indentation 30 is quite shallow, and may be on the order of 3 mm. The indentation will provide the benefit of increasing the length of time during the orbiting cycle at which economizer fluid can be injected into a compression chamber 51. The opposed injection port 27 is directing refrigerant into a compression chamber 50. As shown in FIG. 2B, the compression chambers 50 and 51 are defined as the volumes contained between the fixed scroll wraps 15 and orbiting scroll wraps 33. It is desirable to have approximately equal amounts of refrigerant injected into the two compression chambers 50 and 51, however, due to the geometry of the scroll wrap 15, and various other features, as will be explained below, achieving this equal injection goal is difficult. Thus, the indentation 30 has been added. The indentations can also be added if a designer wants to maximize the amount of the injected refrigerant into one of the chambers.

FIG. 2B shows the rear of the non-orbiting scroll 22. As shown, a rear face 31 includes a passage 32, which communicates with the economizer passage 20, as known. A groove 34 communicates with inlets 36 and 38 to the injection ports 23 and 27. As is known, fluid passes from the passage 20 into the passage 32, the groove 34, and communicate through the inlets 36 and 38 to the injection ports 23 and 27. This flow structure is disclosed in U.S. Pat. No. 6,430,959.

Figure 3:
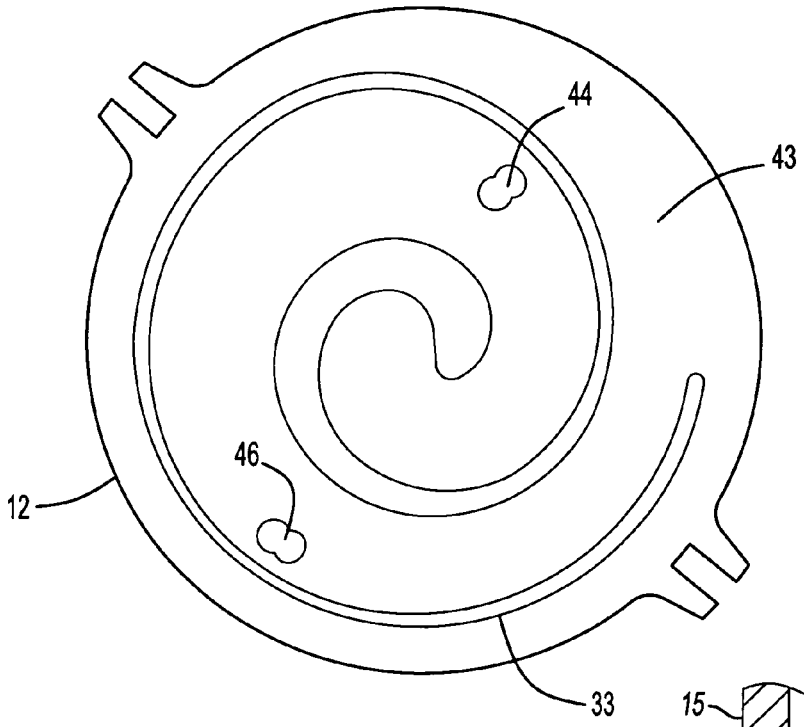
FIG. 3 shows the front face of the orbiting scroll.

As shown in FIG. 3, an orbiting scroll 40 includes a wrap 33 which can also be of the hybrid shape, and which extends from a base 43. The base 43 includes grooves 44 and 46, cut into the base 43. This structure is also disclosed in U.S. Pat. No. 6,430,959.

Figure 4:
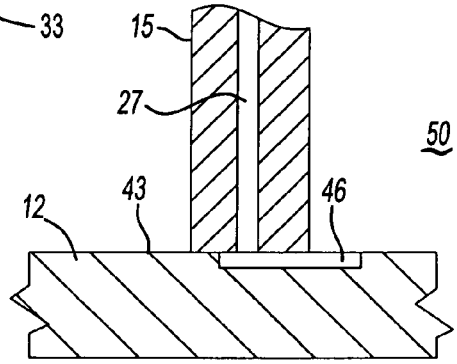
FIG. 4 shows one portion of the inventive scroll compressor.

As shown in FIG. 4, during the operational cycle of the scroll compressor, the orbiting scroll 12 will move relative to the non-orbiting scroll 14, such that the base 43 of the orbiting scroll 12 will slide over the tip of non-orbiting scroll wrap 15. As shown in FIG. 4, the injection port 27 is communicating with the groove 46. At this point, there is injection of economizer fluid into the compression chamber 50.

With further orbiting movement, the injection port 27 will no longer align with the groove 46. At this point, economizer fluid will no longer pass from the port 27 into the groove 46 and then from the groove 46 into the compression chamber 50.

Figure 5A:
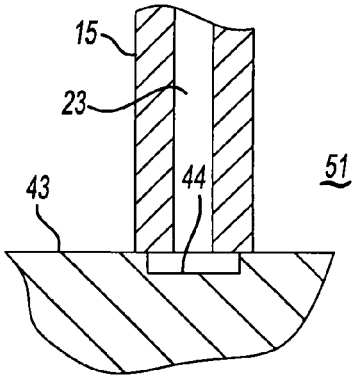
Fig-5A PRIOR ART
FIG. 5A shows another portion in the prior art.

As shown in prior art FIG. 5A, the other injection port 23 is at a thicker portion of the non-orbiting scroll wrap 15. At times, even though there is communication between the groove and the port, the entirety of the groove 44 could be covered by the thicker wrap portion, and thus no refrigerant would be injected from the port 23 into the compression chamber 51. For various reasons (as for example including geometrical constraints, creating undesirable leakage passage, additional costly machining operation), simply increasing the size of the groove or the port is not a viable option.

Figure 5C:
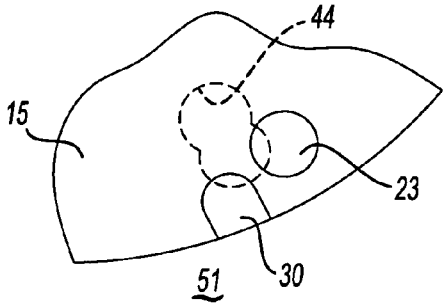
FIG. 5C is a top view of the FIG. 5B structure.
Figure 5B:
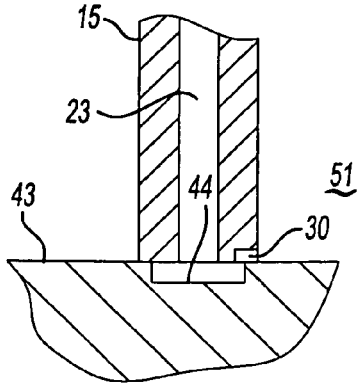
FIG. 5B shows an improvement to the FIG. 5A structure.

Thus, as shown in FIG. 5B, the indentation 30 is added to an outer edge of the wrap (see FIG. 2B). The refrigerant can now flow from the injection port 23, into the groove 44, and through the indentation 30 into the compression chamber 51.

As shown in FIG. 5C, and as can be appreciated, the use of the indentation substantially increases the period of the orbiting cycle at which refrigerant can flow from the injection port 23, and into the compression chamber 51. Also a similar indentation, if needed, can be added to the outer edge of the wrap for the opposite port, thus, the amount of the injected flow can be increased into both pockets if indentations are added for each of the injection ports. Also in case of a single indentation, the scroll compressor designer is able to achieve better control, and more equal flow of the economizer fluid into the opposed compression chambers 50, 51.

Further, the indentation increases the time at which the unloader function can operate to tap refrigerant into the injection port 23, and outwardly of the compressor into the by-pass line 17. A general operation of by-pass unloading in conjunction with the economized vapor injection can be for example found in the U.S. Pat. No. 5,996,364. It also should be noted, that while the FIGS. 2B, 5B, and 5C examples are given only for one indentation placed on one portion of the wrap, another similar indentation can be added to the other portion of the wrap to enhance the unloader function. In this case this second indentation would interact in a similar fashion with other opposite groove and other opposite injection port. It also should be noted that there it is possible to have more than one injection port on the same side of the wrap as described in U.S. Pat. No. 6,430,959, each of this ports can have a similarly arranged indentation to increase the amount of refrigerant flow through each of these ports.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said second scroll member being driven to orbit relative to said first scroll member and said wraps of said first and second scroll members interfitting to define compression chambers;

an economizer passage communicating a fluid into a housing for said scroll compressor, said economizer passage communicating with a supply passage in one of said first and second scroll members, said supply passage communicating with at least one injection port, said injection port formed to extend through said wrap of said one of said first and second scroll members, and the other of said first and second scroll members being formed with at least one groove in said base to be selectively aligned with said at least one injection port as said second scroll member orbits relative to said first scroll member to communicate the fluid into said at least one compression chamber; and at least one indentation formed in said wrap of said one of said first and second scroll members, said at least one indentation communicating with said at least one groove, at least at a time when said wrap of said one of said first and second scroll members otherwise covers at least partially said at least one groove such that refrigerant can continue to communicate with said at least one compression chamber through said at least one indentation, and from said at least one injection port, into said at least one groove, and then through said at least one indentation into said at least one compression chamber.

2. The scroll compressor as recited in claim 1, wherein there is a pair of injection ports and only one being provided with at least one indentation.

3. The scroll compressor as recited in claim 2, wherein said at least one indentation is formed at an outer edge of said wrap of said one of said first and second scroll members, and spaced circumferentially from said at least one injection port.

4. The scroll compressor as recited in claim 1, wherein there is a pair of injection ports and each injection port is being provided with at least one indentation.

5. The scroll compressor as recited in claim 1, wherein said at least one injection port extends through said wrap of said first scroll member.

6. The scroll compressor as recited in claim 1, wherein said wrap of at least one of said first and second scroll members has a non-uniform thickness along a circumferential direction.

7. The scroll compressor as recited in claim 1, wherein said at least one injection port also operates as a bypass port.

8. The scroll compressor as recited in claim 1, wherein said wraps of at least one of said first and second scroll being of a hybrid shape having a non-uniform thickness along a circumferential extent.

9. A refrigerant cycle comprising:

a scroll compressor having first and second scroll members each having a base and a generally spiral wrap extending from said base, said generally spiral wraps interfitting to define compression chambers, said second scroll member being driven to orbit relative to said first scroll member, at least one injection port formed through said wrap of one of said first and second scroll members, and the other of said first and second scroll members being provided with at least one groove in its base to be selectively aligned with said at least one injection port during a portion of an orbiting cycle of said second scroll member to control a fluid movement through said at least one injection port;

a condenser downstream of said compressor, an expansion member downstream of said condenser, and an evaporator downstream of said expansion device;

an economizer heat exchanger selectively communicating a portion of a refrigerant downstream of said condenser back to said compressor, said economizer heat exchanger selectively communicating an economizer refrigerant through a passage which in turn communicates with said at least one injection port in said wrap of said one of said first and second scroll members; and at least one indentation formed in said wrap of said one of said first and second scroll members, said at least one indentation communicating with said at least one groove, at least at a time when said wrap of said one of said first and second scroll members otherwise covers at least partially said at least one groove such that refrigerant can continue to communicate with said at least one compression chamber from said at least one injection port, into said at least one groove, and then through said at least one indentation into said at least one compression chamber.

10. The refrigerant cycle as set forth in claim 9, wherein said at least one economizer injection port is formed through said wrap of said first scroll member.

11. The refrigerant cycle as set forth in claim 9, wherein there is a pair of economizer injection ports and a pair of said grooves, and only one being provided with at least one indentation.

12. The refrigerant cycle as recited in claim 9, wherein said at least one indentation is formed at an outer edge of said wrap of said one of said first and second scroll members, and spaced circumferentially from said at least one injection port.

13. The refrigerant cycle as recited in claim 9, wherein at least one of said wraps of said first and second scroll members has a non-uniform thickness along a circumferential direction.

14. The refrigerant cycle as recited in claim 9, wherein an unloader line includes a valve to selectively communicate said passage back to a suction line for said compressor, such that said at least one injection port operates as both an economizer injection port, and as an outlet to take refrigerant from said at least one compression chambers during unloaded operation.

* * * * *